US005669166A

United States Patent [19]

Verret

[11] Patent Number: 5,669,166

[45] Date of Patent: Sep. 23, 1997

[54] CASING FOR SIGN

[76] Inventor: Normand Verret, 68 P'Tiso Park, Edmundston N. B., Canada, E3V 3X7

[21] Appl. No.: 540,586

[22] Filed: Oct. 6, 1995

[51] Int. Cl.[6] ..... G09F 17/00

[52] U.S. Cl. ..... 40/603; 40/604

[58] Field of Search ..... 40/603, 604; 403/274, 403/276, 279, 281, 282

[56] References Cited

U.S. PATENT DOCUMENTS

| | | | |
|---|---|---|---|
| 4,632,592 | 12/1986 | Gunter | 403/282 X |
| 4,649,628 | 3/1987 | Allemandou | 403/274 X |
| 4,746,240 | 5/1988 | Tarum et al. | 403/282 |
| 4,760,634 | 8/1988 | Rapp | 403/292 X |
| 4,864,756 | 9/1989 | Rasmussen | 40/603 |
| 5,051,020 | 9/1991 | Schleicher | 403/282 |
| 5,255,459 | 10/1993 | Verret | 40/603 |

FOREIGN PATENT DOCUMENTS

| | | |
|---|---|---|
| 909506 | 9/1972 | Canada . |
| 986304 | 3/1976 | Canada . |
| 1288591 | 9/1991 | Canada . |

*Primary Examiner*—Joanne Silbermann
*Attorney, Agent, or Firm*—Mario D. Theriault

[57] ABSTRACT

A casing for sign comprising a backing sheet and side members having each a lip along an edge of the backing sheet. The sign casing further comprises a crimp or a plurality of crimps in the lip of each side member and into the backing sheet for retaining the backing sheet to the side members. The lip of each side member is adjacent a first side of the backing sheet, and a lateral portion of each side member is adjacent a second side of the backing sheet. The lip and the lateral portion of each side member form a slot enclosing an edge of the backing sheet. The lateral portion of the side member further has a groove facing the lip, for receiving a swollen portion of the crimp. The casing is manufactured on a production table having a central top surface, a first side surface and a second side surface. The first side surface and the second side surface have respectively a first longitudinal shoulder for laterally supporting a first side member of the casing, and a second longitudinal shoulder for laterally supporting a second side member of the casing during manufacturing thereof. The production table further has adjustment means to selectively move the first side surface in a coplanar and parallel relationship with the second side surface, such that the production table may be adjusted to manufacture sign casings of different widths.

15 Claims, 16 Drawing Sheets

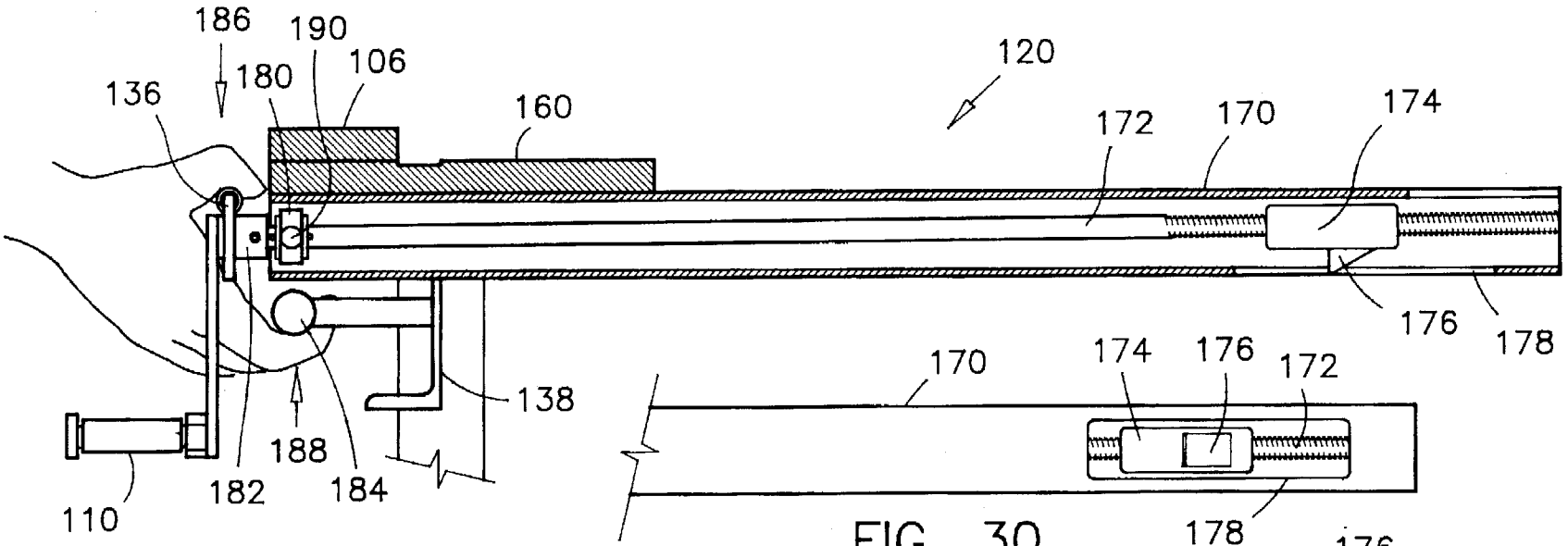
FIG. 29
FIG. 30
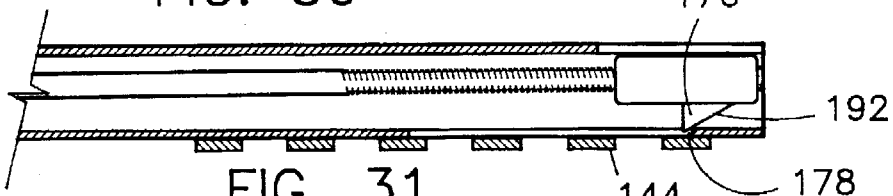
FIG. 31
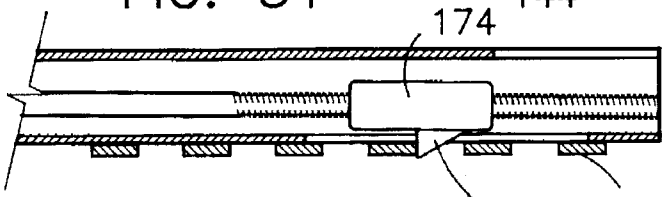
FIG. 32
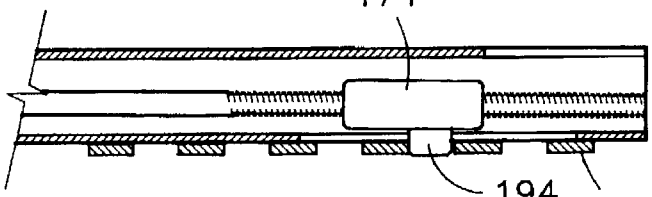
FIG. 33

CASING FOR SIGN

FIELD OF THE INVENTION

The present invention relates to sign casings and to apparatus for manufacturing such sign casings. More particularly, the present invention relates to a sign casing which is assembled on an adjustable production table by crimping portions of the side members thereof into a backing sheet.

BACKGROUND OF THE INVENTION

A typical sign casing of the prior art related to the type of sign casing of the present invention is described in my U.S. Pat. 5,255,459 issued Oct. 26, 1993. The sign described therein generally comprises a casing, a skeletal structure, a flexible face material and a light source within the casing. Signs of that type may span great length to cover the contour of a gas bar canopy for example.

A typical rectangular sign of the prior art normally has a backing sheet joining two side members by means of rivets, or screws. These rectangular signs are normally manufactured in several sections, which are individually crated and transported to the clients' premises by trucks, and assembled prior to installation on a supporting structure.

It is a common problem with these signs that a portion of the rivets or screws retaining the backing sheet to the side members protrude outside the casing, Such stems sticking out of the rearward face of the casing are undesirable obstructions hindering the crating and handling of the casing, and preventing a flush mounting thereof on a supporting wall for example.

On the other hand, when the screws and rivets are driven from the outside of the casing such as the sign frame illustrated in U.S. Pat. No. 5,127,177 issued on Jul. 7, 1992 to James A. Tanner, the frame is firstly assembled on a production table, and turned upside down during the installation of the fasteners retaining the backing sheet to the side members. The sign is then returned to its initial position for installing the electrical wiring, the lamps and reflectors. Such manipulation of the casing adds to the manufacturing labour cost of these signs.

In other instances, the backing sheet is sometimes attached to the side members by a combination of screws or rivets and interlocking lips. Examples of these signs are disclosed in Canadian Patents 909,506 and 1,288,591 issued on Sep. 12, 1972 and on Sep. 10, 1991 respectively, both to Johann Stilling. The backing sheet of these signs requires a folded portion along the edges thereof, to mate into corresponding lips on the side members. The forming of these folds is another procedure which adds to the manufacturing cost of the signs.

In a broader practice, components of a sign casing are normally made of aluminum such that the sign will not corrode when installed outside. Hence the rivets or screws joining the backing sheets to the side members are also normally made of aluminum, having a relatively low shear strength as compared to steel rivets for example.

Therefore it is further a common problem with these signs, and especially with aluminum fasteners, that the rivets or screws shear off during handling and installation of the casing on a supporting structure. The additional work required to repair the casing during installation also adds to the labour cost of the sign.

From a productivity point of view, a conventional method for manufacturing sign casings consists of assembling the components on a flat table having the width of a maximum width for sign casings. Workers assembling signs in a conventional manner often use carpenter clamps to hold the side members against a skeletal structure made of several C-frames, while rivets and screws are driven through the side members, into the C-frames and into the backing sheet.

When manufacturing narrow sign casings, workers on one side of the table are standing too far from their respective side member to maintain a comfortable working posture. Therefore it is a common practice that the casing is pushed and pulled back and forth across the production table such that the working of each side of the casing is done as close as possible from a respective edge of the table. This is another manipulation which adds to the production costs of signs.

SUMMARY OF THE INVENTION

In the present invention however, there is provided a casing for sign comprising a backing sheet and side members having each a lip along an edge of the backing sheet. The sign casing of the present invention further comprises a crimp or a plurality of crimps in the lip of each side member and into the backing sheet for retaining the backing sheet to the side members.

A first advantage of this embodiment is that the sign casing is assembled without fasteners. The drilling operation associated with rivets and screws of the prior art casings is eliminated.

The sign casing of this embodiment is free from pointed fasteners protruding from the rear face thereof. Hence the sign casing of the present invention has a better appearance than the prior art casings, and it may be flush mounted on a flat surface.

In accordance to another aspect of the present invention, the lip of the side member is adjacent a first side of the backing sheet, and a lateral portion of the side member is adjacent a second side of the backing sheet. The lip and the lateral portion of each side member form a slot enclosing an edge of the backing sheet. The lateral portion of the side member further has a groove facing the lip, such that a swollen portion of the crimp in the backing sheet bulges into that groove.

A second advantage of this other aspect of the present invention is that the crimp in the lip, into the backing sheet and into the groove of the lateral portion of the side member has greater shear strength than common aluminum fasteners used in the prior art signs.

In accordance to yet another aspect of the present invention, there is provided an apparatus for manufacturing sign casings with consistent dimensions. The apparatus comprises a production table having a central top surface, a first side surface adjacent a first side of the central top surface, and a second side surface adjacent a second side of the central top surface.

The first side surface and the second side surface have respectively a first longitudinal shoulder for laterally supporting a first side member of the sign casing during manufacturing thereof, and a second longitudinal shoulder for laterally supporting a second side member of the sign casing during manufacturing thereof.

The production table of the present invention further has adjustment means to selectively move the first side surface in a co-planar and parallel relationship with the second side surface, such that the table may be adjusted to manufacture sign casings of different widths. The production table of the present invention is used as an adjustable jig whereby the set-up time between batches of signs is minimal.

Workers manufacturing sign casings on such an adjustable production table and standing on either side thereof are always within reach of the casing without having to stretch into uncomfortable posture. The productivity of these workers is thereby improved over those tradesmen working on conventional wide tables.

In accordance to a further aspect of manufacturing signs of the present invention, the apparatus as described above, may also comprise a storage rack containing a supply of components of sign casings.

A new method of manufacture obtained from a combination of a storage rack mounted near an end of the production table of the present invention comprises the steps of;

A) positioning each side member of a sign casing along a respective shoulder on the production table;

B) sliding and guiding a backing sheet in a single motion from the storage rack, onto the production table, and into the slots of the side members;

C) crimping the lips of the side member into the backing sheet for retaining the backing sheet to the side members.

Such a method of manufacture produces sign casings of consistent dimensions and having strong connections joining the parts.

The sign casing of the present invention has side members made of extruded aluminum profiles which do not require working other the trimming to length. Similarly, the backing sheet is a flat sheet which does not require working other than dimensioning. The crimping of the side members into the backing sheet is easier done than installing rivets or screws, and it does not add to the material cost of the sign. Therefore, the manufacturing of sign casings of the present invention, using a production table and a component storage rack as those just described, provides a new method of manufacture which is highly productive.

BRIEF DESCRIPTION OF THE DRAWINGS

The preferred embodiment of the invention will be further understood from the following description, with reference to the drawings in which;

FIG. 29 is a cross section along a latching member of a side extension of the production table. The illustration shows the latch mechanism, and a method for releasing it during adjustment of the production table.

FIG. 30 is a bottom view of a first model of latch block having one vertical engaging surface and an opposite inclined surface.

FIG. 31 is a cross section of a latch mechanism of a side extension, showing the latch block in a recess position inside the rectangular tubing.

FIG. 32 shows the latch block in a latch position against a latch bar on the frame of the production table.

FIG. 33 illustrates a second model of latch block having two opposite vertical engaging surfaces.

DETAILED DESCRIPTION OF THE PREFERRED EMBODIMENT

Figure 1:
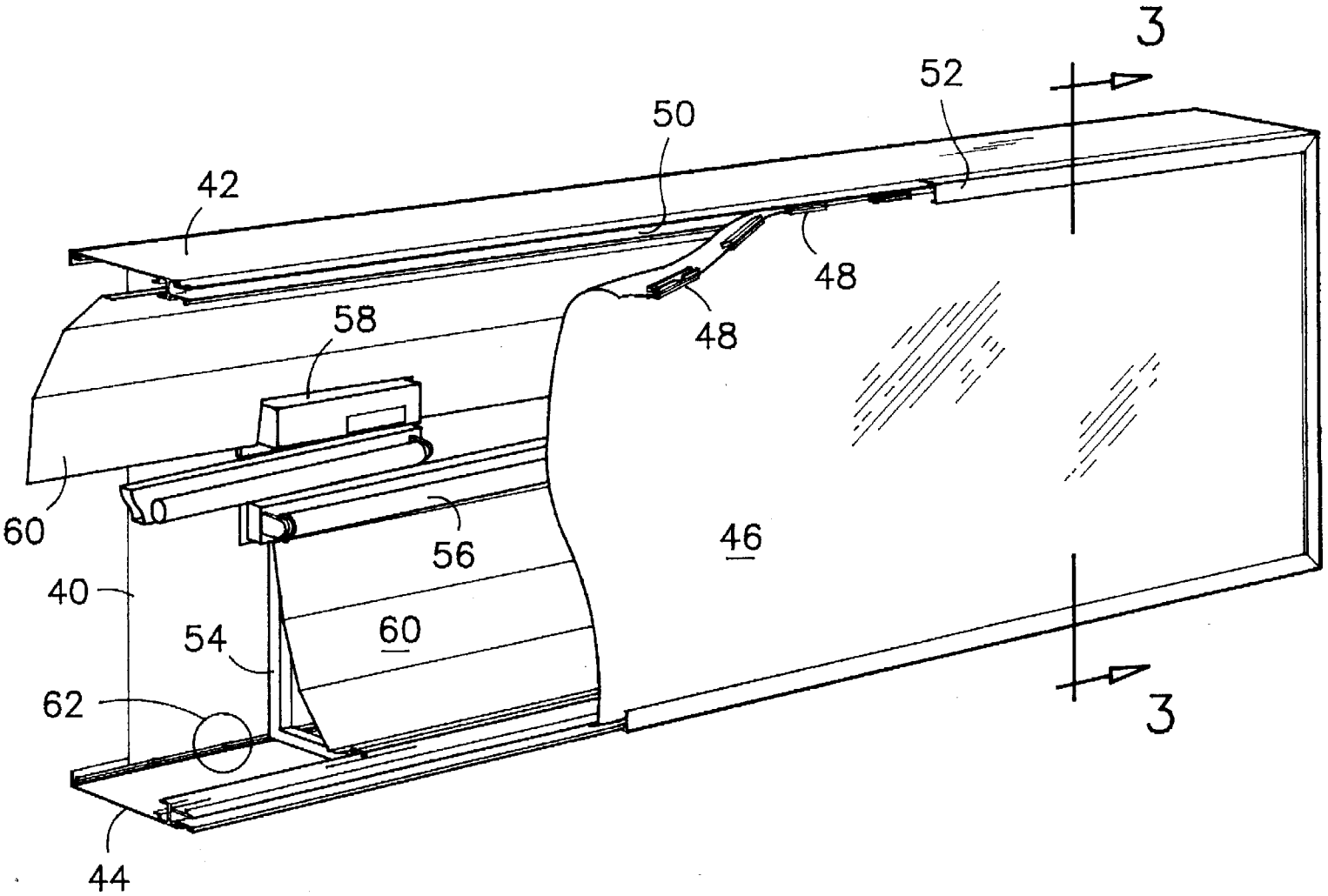
FIG. 1 illustrates a rectangular sign of the type related to the present invention.

Referring to FIG. 1, there is illustrated a section of a rectangular sign comprising a backing sheet 40, a top side member 42, a bottom side member 44, a flexible face material 46, and a plurality of flex holders 48 closed on the edge of the flexible face material 46, for retaining the face material into a slot 50 along the periphery of the sign. The slot 50 is covered entirely by a corner cap 52 after installation of the flexible face material 46.

The sign of the preferred embodiment also comprises spaced apart C-frame members 54 for stiffening the casing. The light source of the sign normally comprises fluorescent lamps 56, a ballast 58, and reflectors 60.

The top and bottom side members 42 and 44 of the sign casing of the preferred embodiment are joined to the backing sheet 40 by means of crimps 62 at regular intervals, along the inside corners of the casing.

Figure 2:
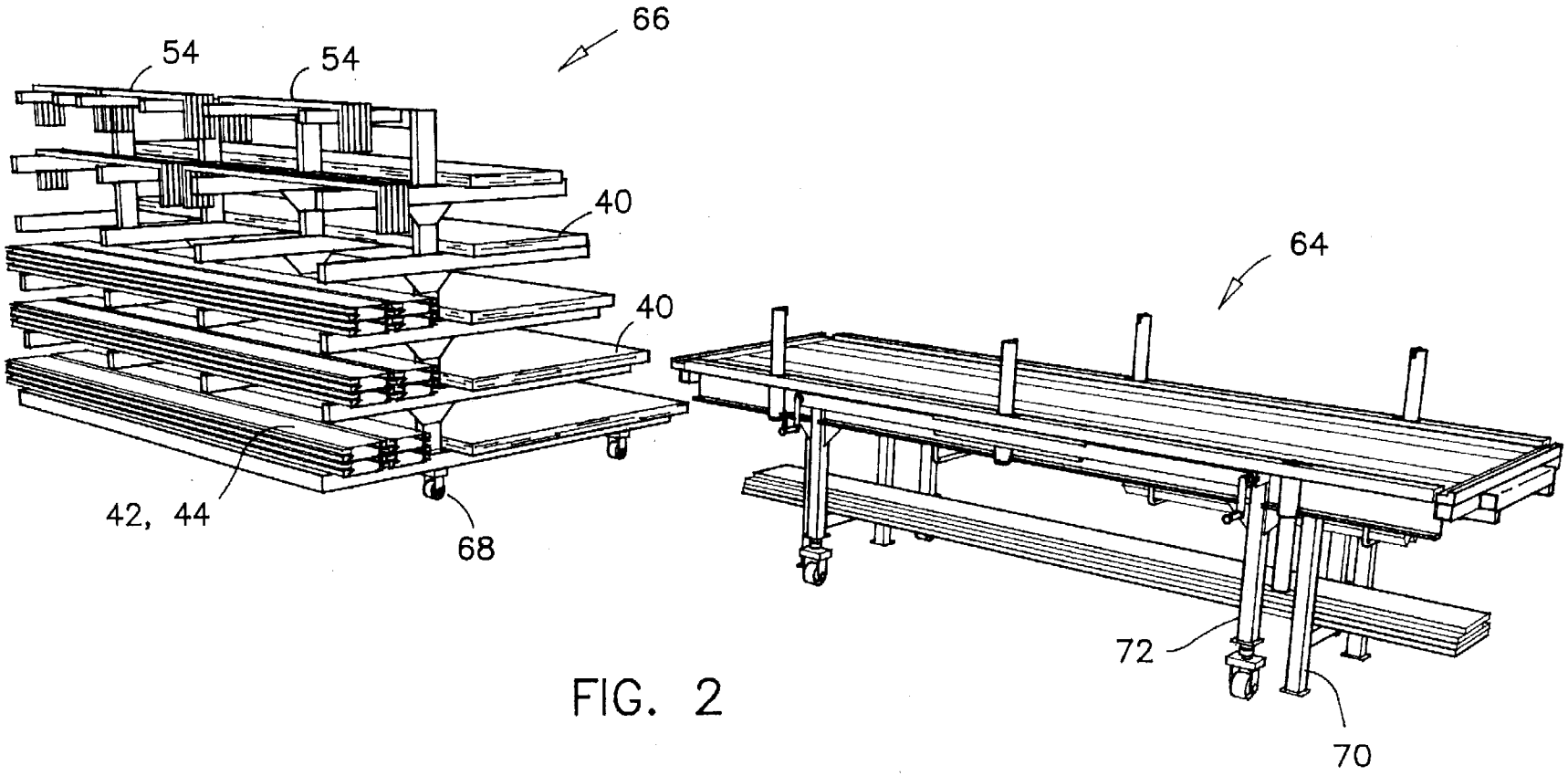
FIG. 2 illustrates a production table for manufacturing sign casings, and a storage rack for storing a supply of components required in the fabrication of sign casings of the present invention.
Figure 3:
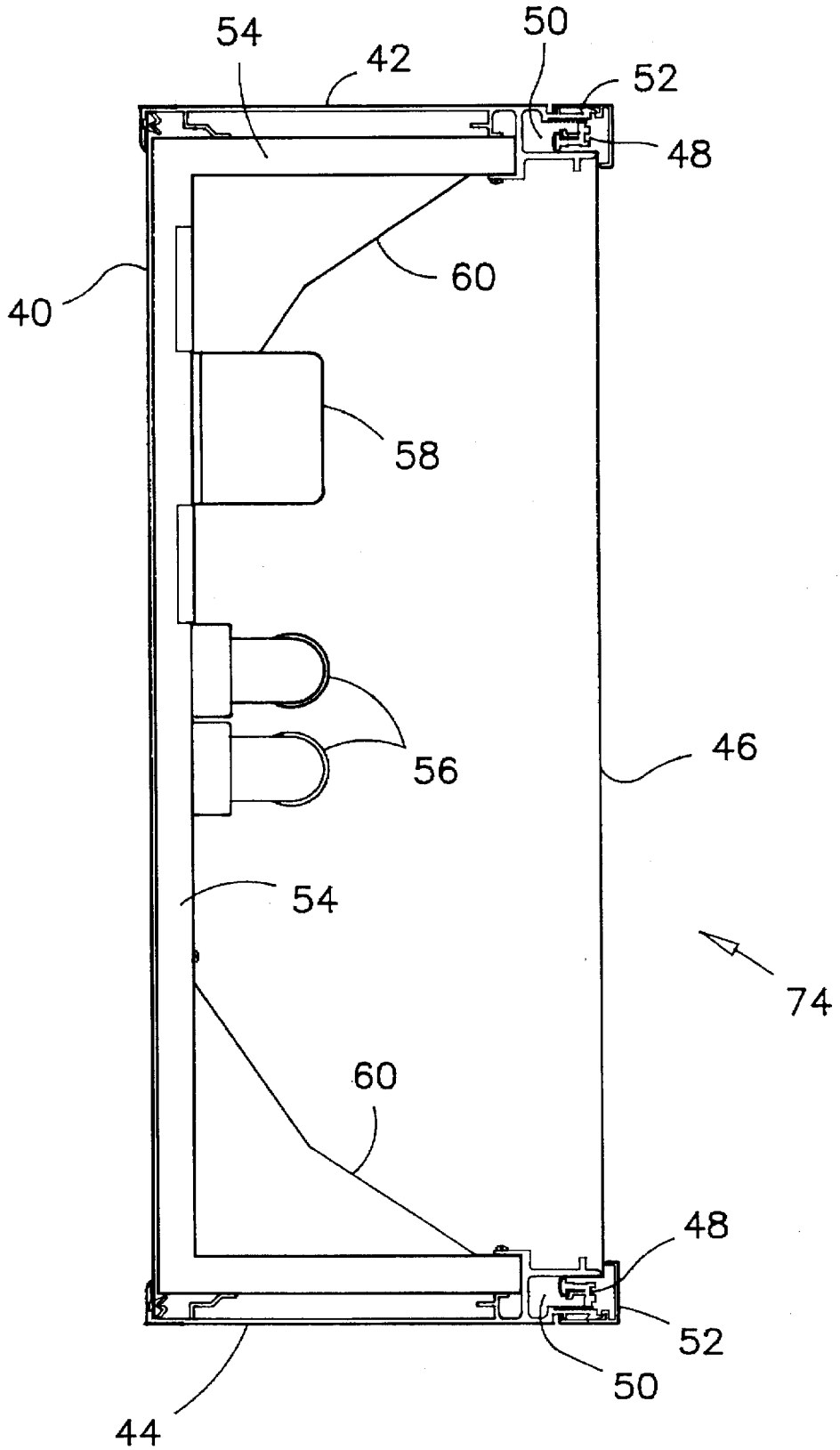
FIG. 3 is a cross section of a sign casing, along line 3—3 of FIG. 1.
Figure 4:
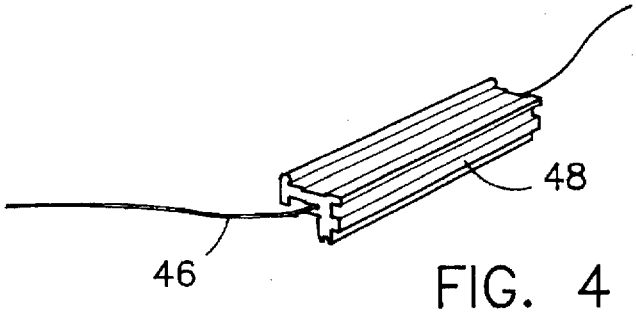
FIG. 4 illustrates a flex holder crimped on an edge of a flexible face material of a sign.
Figure 5:
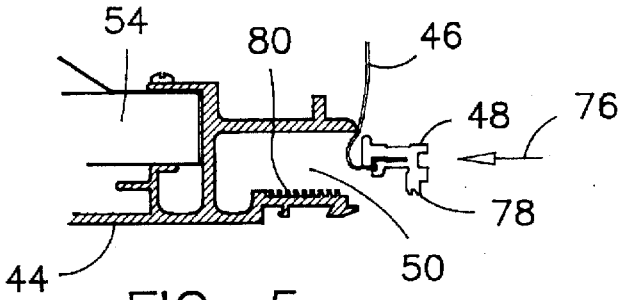
FIG. 5 shows the positioning of a flex holder into a slot on a forward periphery of a sign casing.
Figure 6:
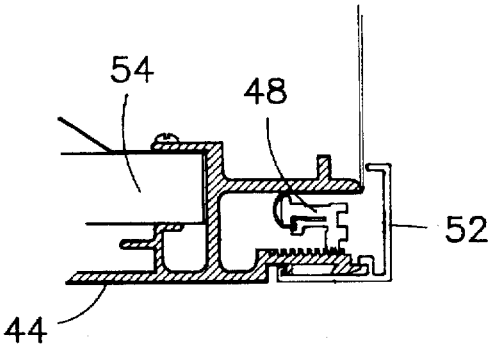
FIG. 6 illustrates a flex holder in its final position in the peripheral slot, and a corner cap covering the forward slot around the casing.
Figure 7:
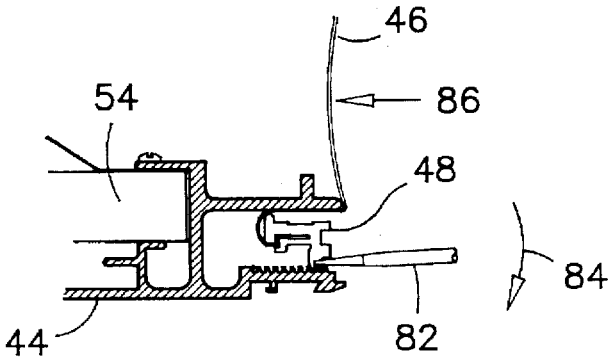
FIG. 7 illustrates the removal of a flex holder from a peripheral slot around the casing, during opening of the casing for maintenance for example.

When referring to FIG. 2, there is illustrated the apparatus for manufacturing sign casings in a novel manner. The sign making apparatus preferably comprises an adjustable production table 64 and a storage rack 66 for storing a supply of components for manufacturing signs.

The storage rack 66 preferably contains a supply of backing sheets 40 of various widths to accommodate standard widths of signs, a supply of standard length side members 42, 44, and a supply of C-frames 54, also of various dimensions to accommodate sign casings of various widths.

The preferred storage rack 66 has casters 68 such that the supply of backing sheets 40 may be aligned with the production table 64 for pulling the backing sheets 40 from the rack 66 and directly onto the production table 64.

The production table 64 of the preferred embodiment has a main frame 70, and an adjustable extension 72 on each side, for manufacturing sign casings of various widths. The production table 64 of the preferred embodiment will be further explained when making reference specifically to FIGS. 13 to 35.

Referring now to FIGS. 3 to 7, there is illustrated for informative purposes, a typical arrangement of a sign casing 74 of the preferred embodiment. A plurality of flex holders 48 are attached onto the edge of the flexible face material 46. During installation of the face material 46, each flex holder 48 is pushed inside a slot 50 on a forward edge of the side member 42 and 44, in the direction of arrow 76, such that the teeth 78 on the flex holder 48 engage into serrations 80 inside slot 50 as illustrated on FIG. 5. The slot 50 is thereafter covered by a corner cap 52 as shown on FIG. 6.

The removal of the flex holder 48 from the slot 50 for opening the sign casing to perform maintenance of the sign for example, is done by prying the flex holder 48 out of the serrations 80 with the blade 82 of a screwdriver in the direction indicated by arrow 84, while applying a pressure in the face material 46 in the direction of arrow 86. This particular movement is illustrated on FIG. 7.

The FIGS. 8 to 12 illustrate the crimping of a deformable lip 90 on the side member 44 for example, into the backing sheet 40. The deformable lip 90 has a V-shaped configuration 92 for receiving a pointed tool such as a cylindrical point 94 of a pneumatic hammer 96. The deformable lip 90 further has a line of reduced thickness 98 adjacent a connection thereof with side member 42 or 44.

A slot 104 between the deformable lip 90 and a lower transversal portion 102 of side member 42 or 44 provides guiding means for sliding a backing sheet 40 from storage rack 66 and onto the production table 64. This slot 104 in cooperation with a spacing between both side extensions 72 provides also the guiding means for positioning backing sheet 40 at a precise lateral placement for crimping the deformable lips 90 thereinto.

When a downward force is applied in the V-shaped groove 92, such as from the percussion of pneumatic hammer 96, the lip 90 deforms about line of reduced thickness 98, and forces the backing sheet 40 to also deform into a square groove 100 in the lower transversal portion 102 of side member 44.

The preferred conical percussion tool 94 has a spherical end, the diameter of which is between about 0.080" to about 0.125". The crimp 62 produced by such tool interlocks the side member 44 with backing sheet 40 without deforming the lower transversal portion 102.

The holding strength of such crimp 62 is superior than the strength of common fasteners. Tests have revealed that the crimp 62 has a shear strength of about 8 to 10 times the strength of a common aluminum rivet having a diameter of 0.125". Along these findings, a spacing "A" of about 6 to 10 inches is recommended between each crimp 62 for a sign casing having a width of between about 2 feet to 5 feet. Such a spacing provides sufficient resistance to endure bending and twisting of the casing during transporting and hoisting for example, without affecting the structural integrity of the joints.

Figures 8, 9:
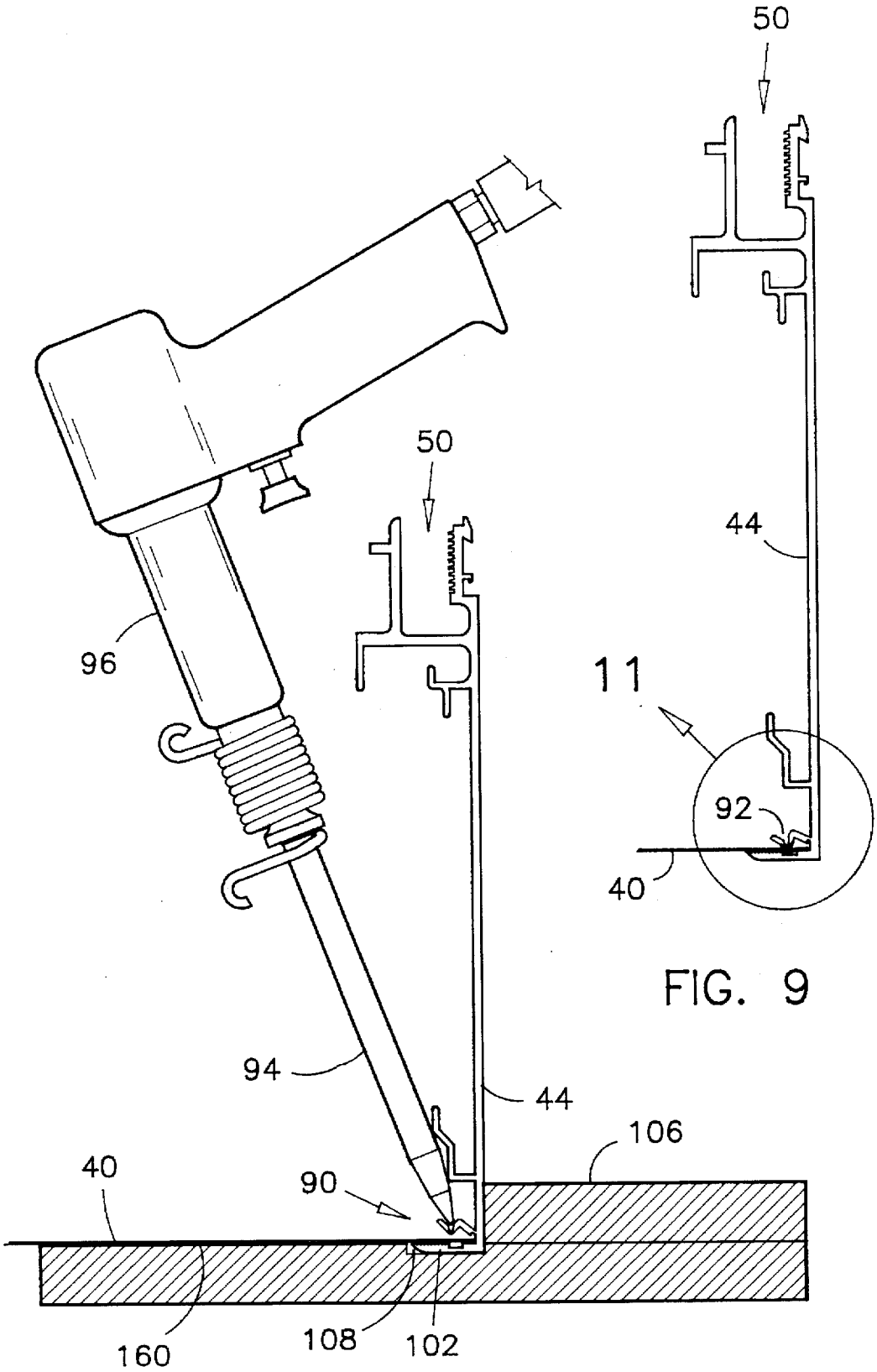
FIG. 8 illustrates a preferred method for crimping the lip of the side member into the backing sheet.
FIG. 9 shows the position of the lip after crimping into the backing sheet.
Figure 10:
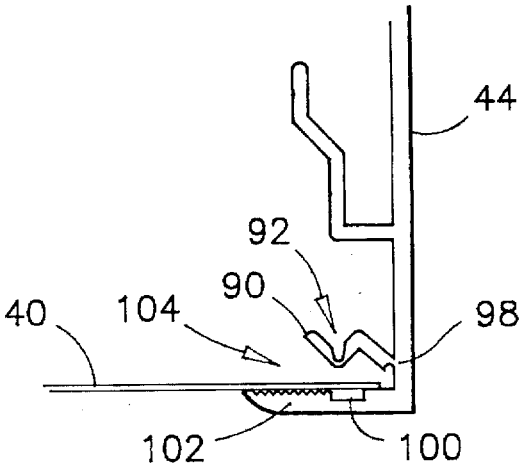
FIG. 10 is an enlarged view of the lip of a side member before crimping into the backing sheet.
Figure 11:
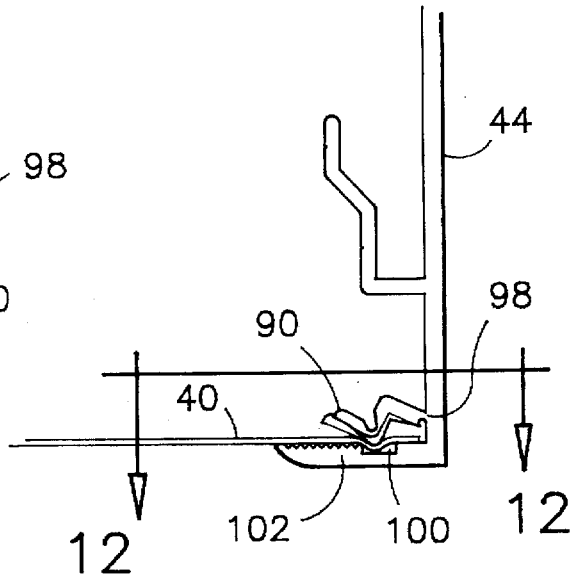
FIG. 11 is an enlarged view of detail 11 on FIG. 9. The figure shows the profile of the lip after crimping into a backing sheet.
Figure 12:
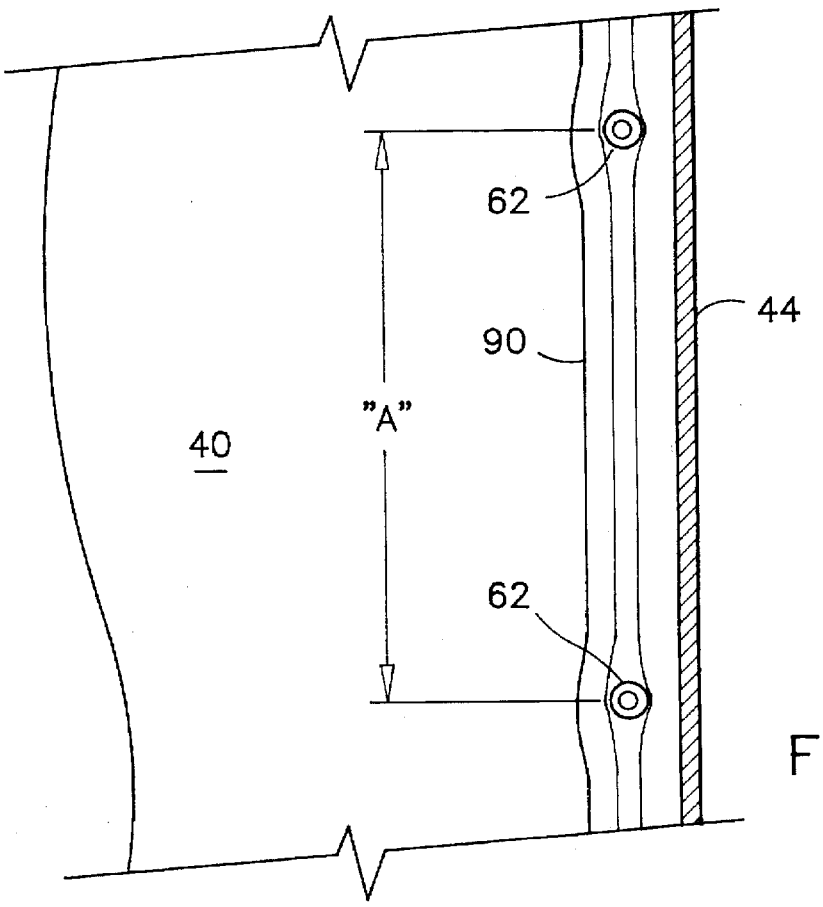
FIG. 12 is a top view of the lip of a side member after crimping into a backing sheet. The illustration is a top view along line 12—12 of FIG. 11.

During the forming of crimps 62, it is recommended to support the side member 44 from both a vertical and a lateral direction, as illustrated by the supporting surface 160 and shoulder 106 of FIG. 8. It is also recommended to assemble the sign casing on a production table having a slot 108 recessed in its surface 160, on each side of the production table. The slot 108 should have the width and thickness of a lower transversal portion 102 of side member 44.

Figure 13:
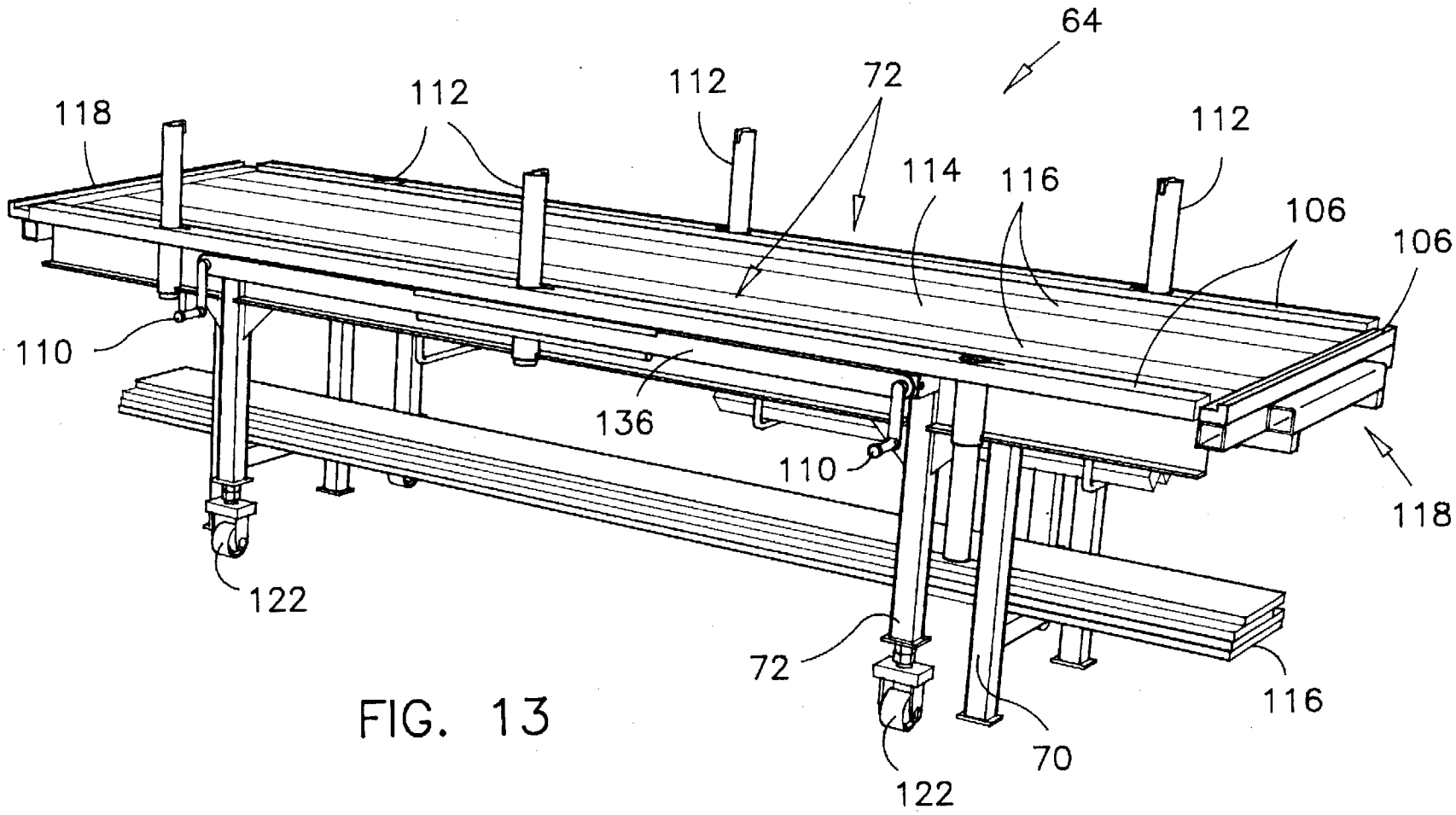
FIG. 13 is an enlarged view of the production table of FIG. 2.
Figure 14:
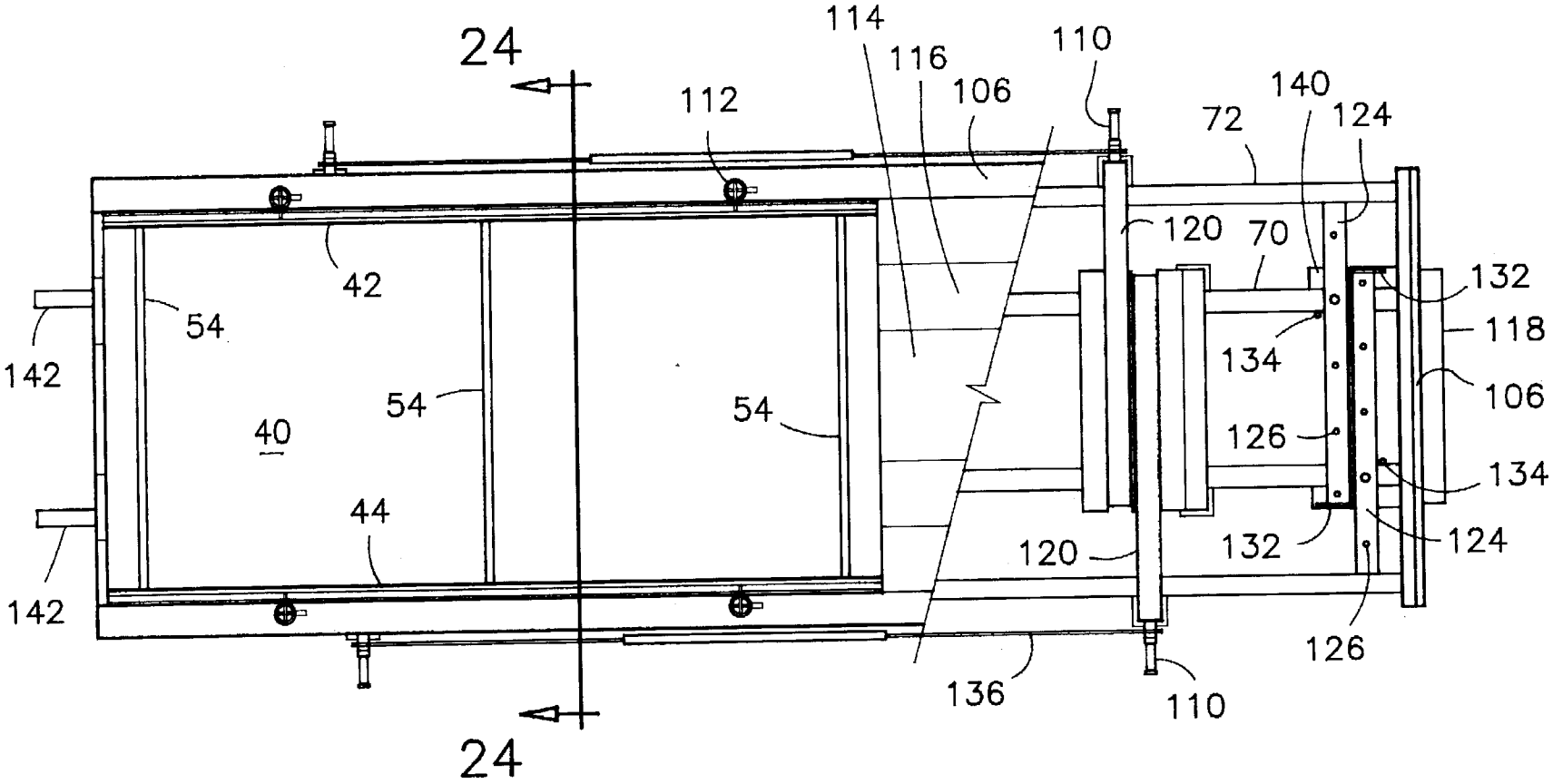
FIG. 14 is a top partial view of the production table of the present invention.
Figure 15:
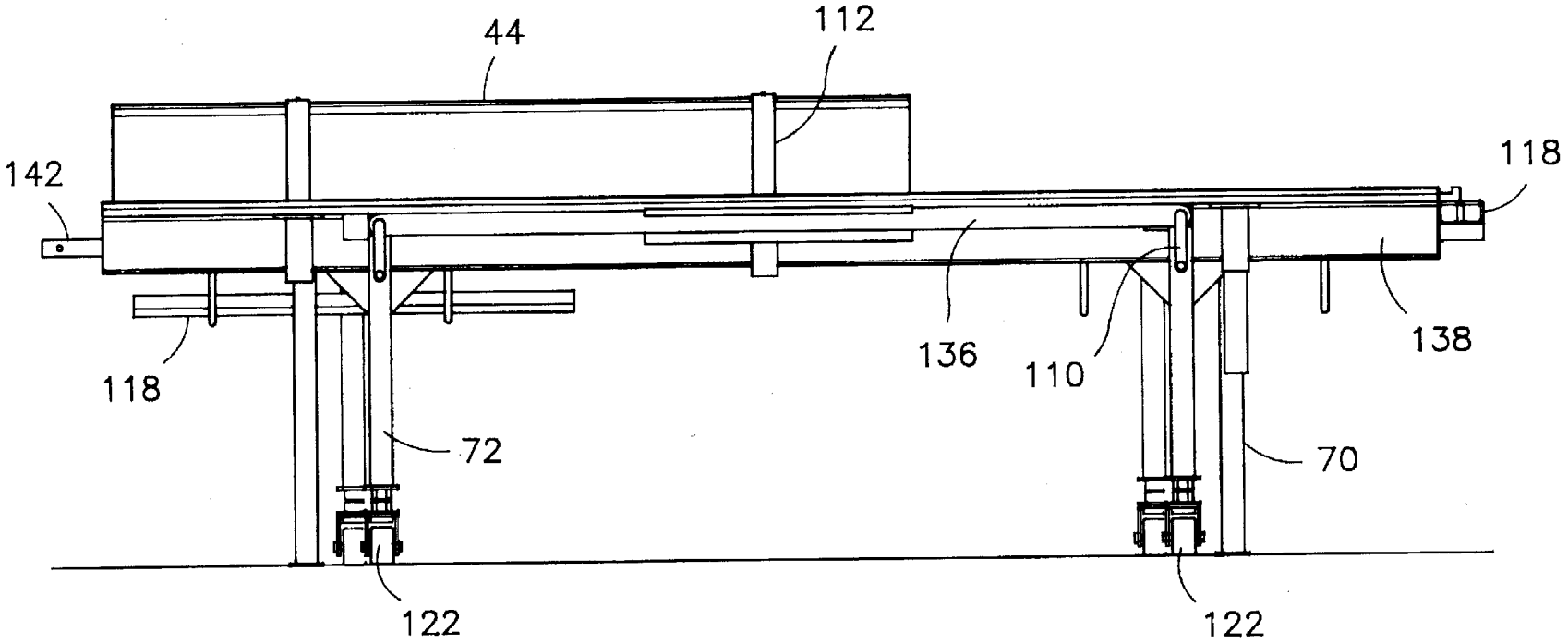
FIG. 15 is a side view of the production table of the present invention.

Referring now specifically to FIG. 13, the preferred production table 64 to manufacture sign casings of the present invention comprises a main frame 70, and an extensible section 72 on each side of the main frame 70. Each extensible section 72 is movable laterally from the main frame 70 to accommodate for manufacturing sign casings of various widths. The displacement of each extensible sections 72 is effected by a pair of latch mechanisms being each operated by a hand crank 110.

Each side extension 72 (extensible section) has a shoulder 106 along its full length, and a series of telescoping vertical holders 112 therethrough.

The production table 64 has a fixed top surface portion 114, and removable boards 116. An assortment of removable boards 116 is stowed underneath the production table 64. The assortment comprises removable board 116 of different widths to accommodate an adjustment of the production table to the widths of most commonly manufactured sign casings.

The production table 64 further comprises a removable abutment member 118 for use when manufacturing an end section of a sign casing. This abutment member 118 also has a shoulder 106 for retaining a side member during the forming of crimps 62 therein.

Referring now to FIGS. 14 to 22, each side extension 72 has a pair of latch mechanisms 120 which are each guided into a respective channel 122 on the main frame 70. Each side extension 72 also has a pair of casters 122 for allowing a smooth lateral adjustment of the production table on a shop floor.

Each side extension further has a pair of lateral arms 124 and a series of spaced apart holes 126 within each arm 124. The main frame 70 has also holes 128 and 130 positioned to align with holes 126 of the lateral arms 124.

A pair of pins (not shown) through holes 126 and into holes 128 or 130, is used to retain each side extension 72 in a fixed relationship with the main frame 70, during the manufacturing of a batch of sign casings for example.

It is also recommended that holes 130 on one side of the main frame 70 be slightly larger than holes 126, such that one side of the table may be slackened during the sliding of a backing sheet 40 into slots 104 of side members 42 and 44, or during the removal of a completed sign casing from the production table. Slot 104 is illustrated on FIG. 10. The slackening of the side extension 72 is done by loosening both crank handles 110.

Each lateral arm 124 on a side extension 72 has a transverse tab 132. The main frame 70 has vertical pins 134 sticking up from a sliding surface for lateral arm 124, such that tab 132 intersects with a respective pin 134, to prevent a separation of the side extension 72 from the main frame 70 during adjustment of the production table.

Each side extension 72 has a structural channel 138 under the line of impact of the percussion tool 96 during the crimping of the lips 90 of side members 42 and 44 on the backing sheet 40. The structural channel 138 maintains a stiffness of the side extension 72 during the fabrication of sign casings.

Figure 16:
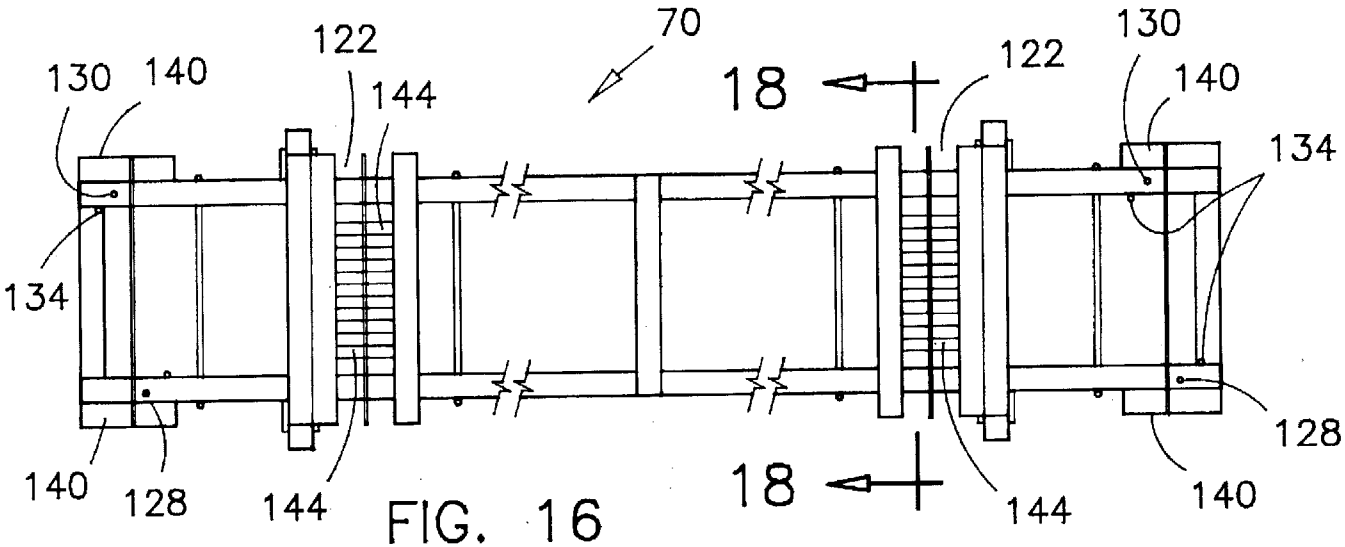
FIG. 16 is a partial top view of the frame of the production table of the present invention.
Figure 17:
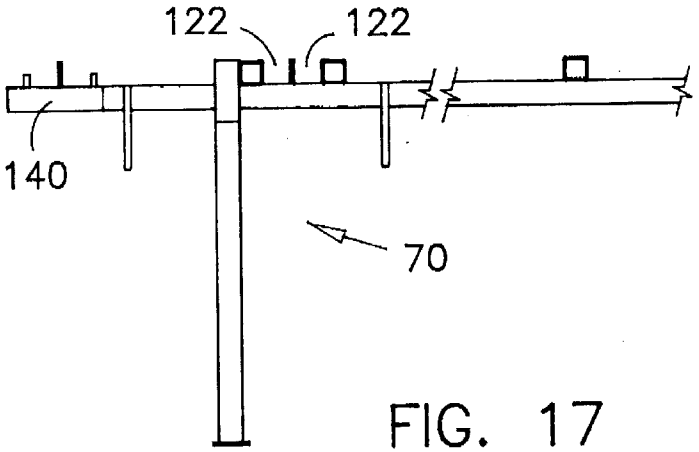
FIG. 17 if a partial side view of the frame of the production table of the present invention.
Figure 18:
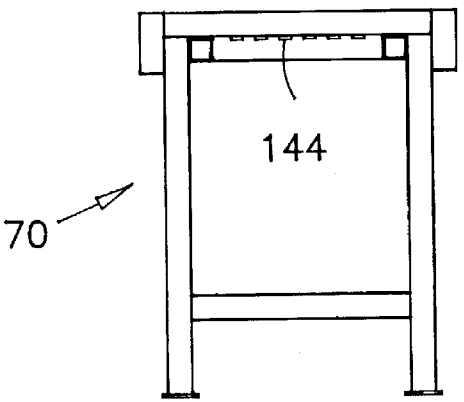
FIG. 18 is a cross section of the frame of the production table of the present invention, along line 18—18 of FIG. 16.
Figure 19:
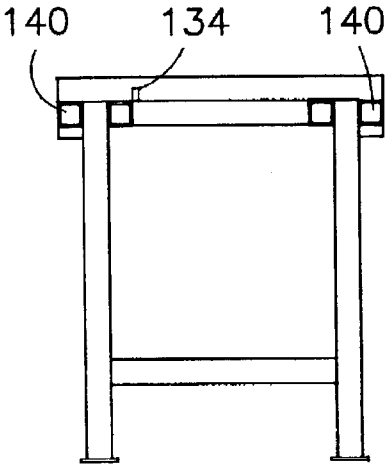
FIG. 19 is an end view of the frame of the production table of the present invention.
Figure 20:
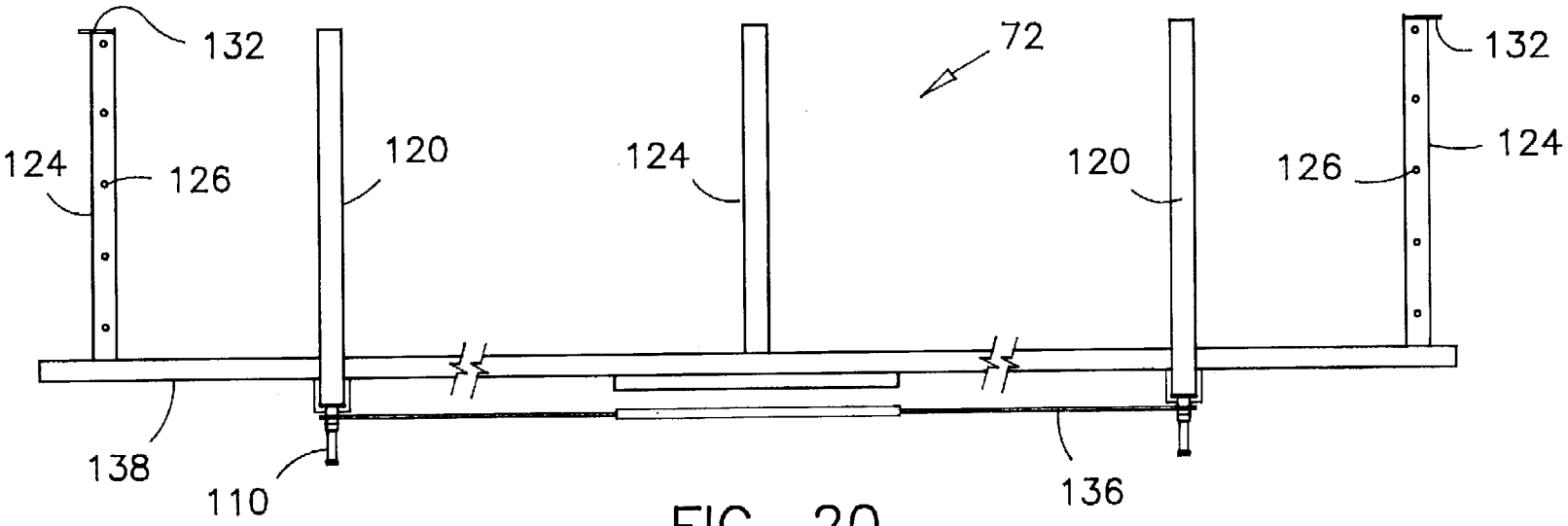
FIG. 20 is a partial top view of a side extension of the production table.
Figure 21:
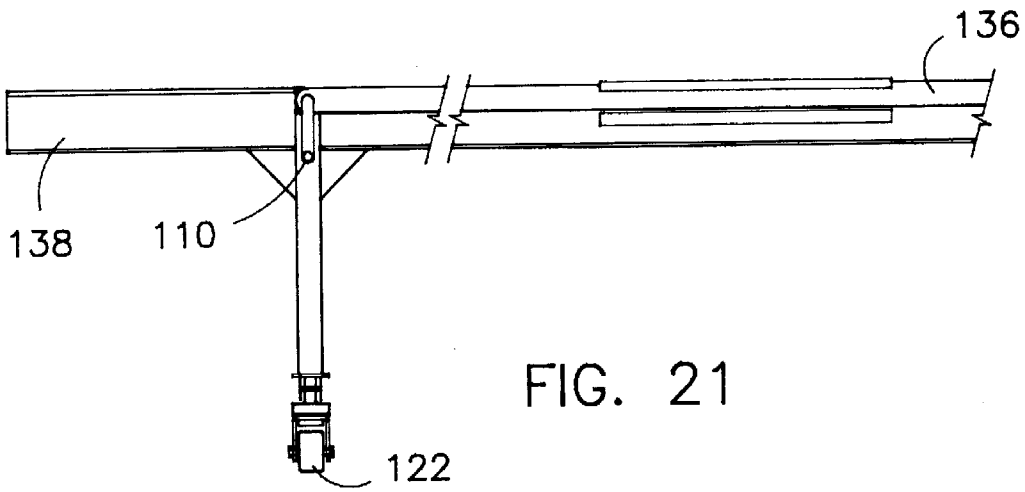
FIG. 21 is a partial side view of the side extension of FIG. 20.
Figure 22:
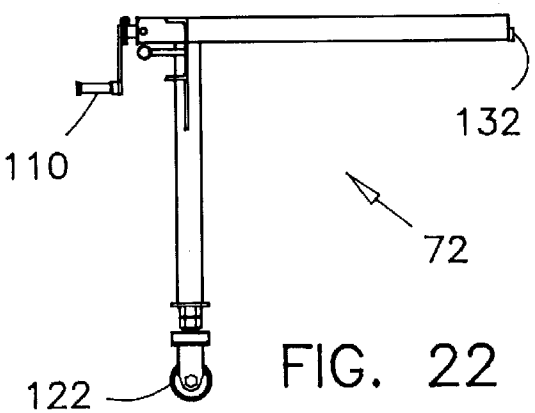
FIG. 22 is an end view of the side extension of FIG. 20.

The abutment member 118 connects into a pair of sockets 140 at either end of the main frame 70, as one may see on FIGS. 16 and 19, These sockets 140 are also used in combination with a pair of link bars 142 to join two production tables end to end for manufacturing sign casings longer than the length of a single production table.

Figure 23:
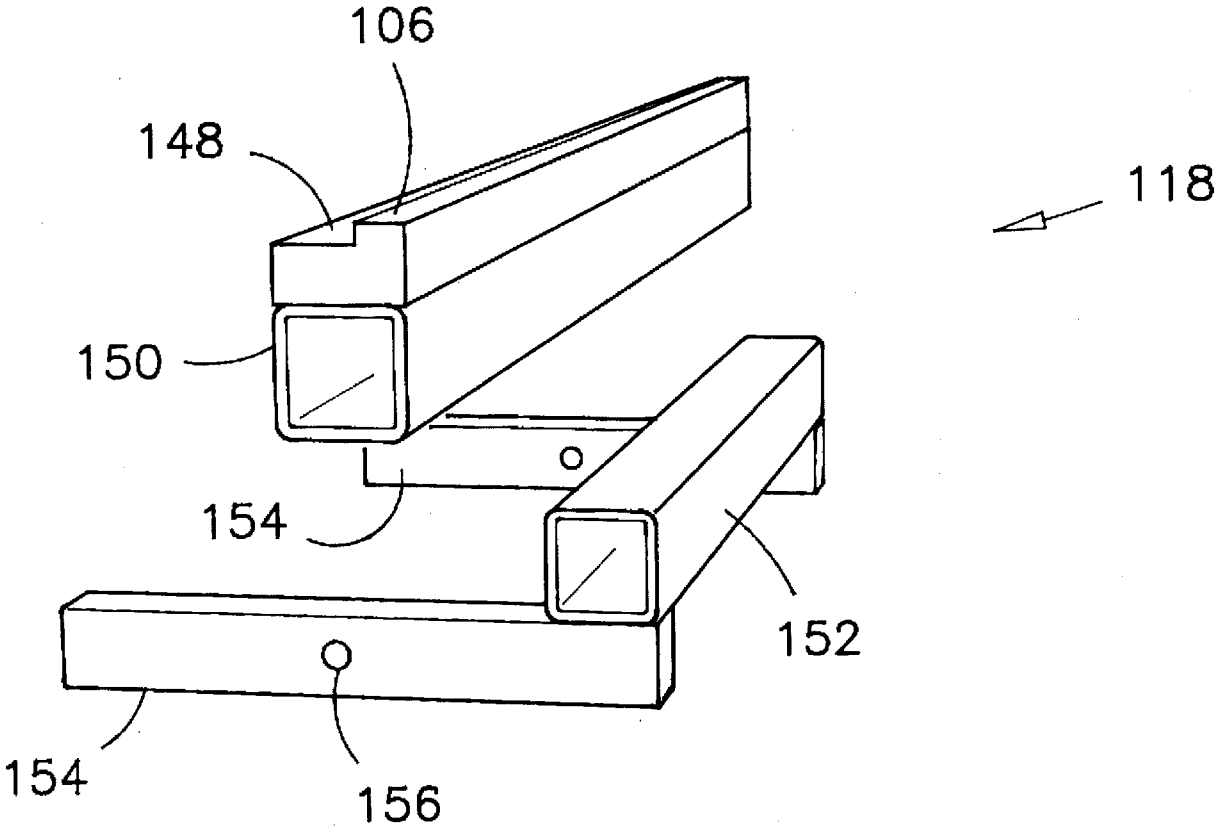
FIG. 23 is a perspective view of an abutment attachment for the production table of FIG. 13.

The abutment member 118, as one may see on FIG. 23, comprises a shoulder 106 and a lower surface 148 for receiving a lower transversal portion 102 of side member 42 or 44. The abutment member 118 further has a structural member 150 which is supported by an adapter frame 152. The adapter frame 152 has two parallel members 154 having each cross section dimensions and a spacing therebetween to fit into a pair of sockets 140 at either end of the main frame 70. Adapter frame 152 may retain structural members 150 of various lengths to accommodate various sign widths.

The abutment member 118 is rigidly secured into sockets 140 by inserting pins (not shown) into a lateral hole (not shown) in each socket 140 and through a respective hole 156 in each parallel member 154.

The joining of two production tables end-to-end may be similarly effected by inserting pins through similar holes (not shown) in link pieces 142.

Referring back to FIGS. 16 and 18, the latch mechanisms 120 of the side extension 72 operates in association with a plurality of spaced apart latch bars 144 on a lower portion of channels 122 of the main frame 70, as it will be later explained when making reference to FIGS. 29 to 32.

Figure 25:
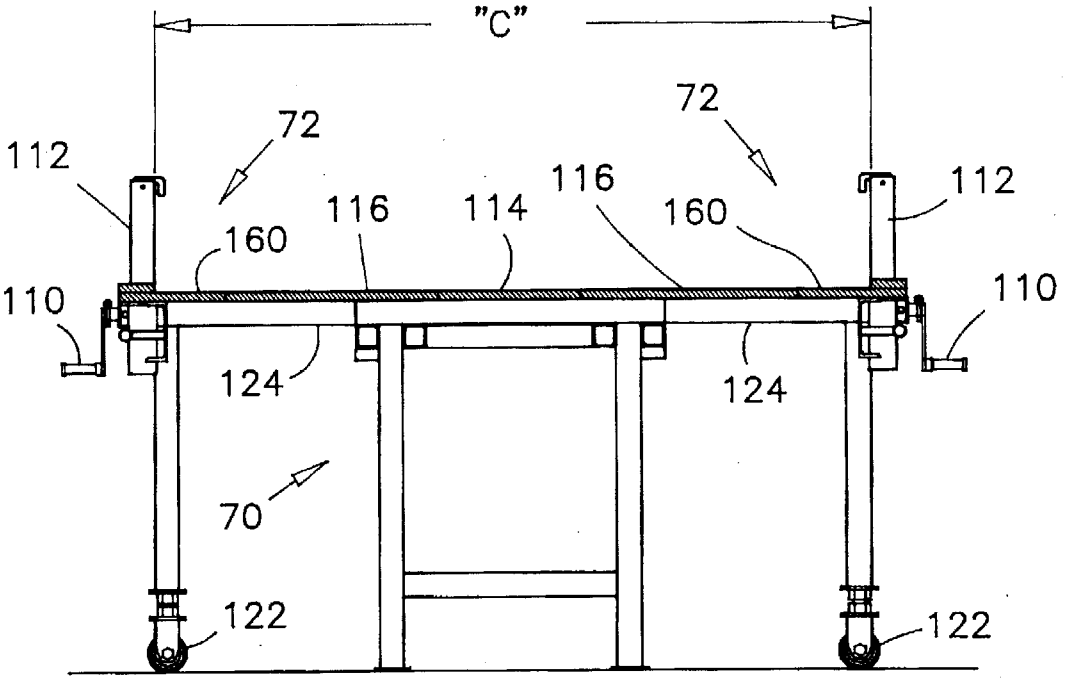
FIG. 25 is another cross section of the production table, with the side extensions fully extended.
Figure 24:
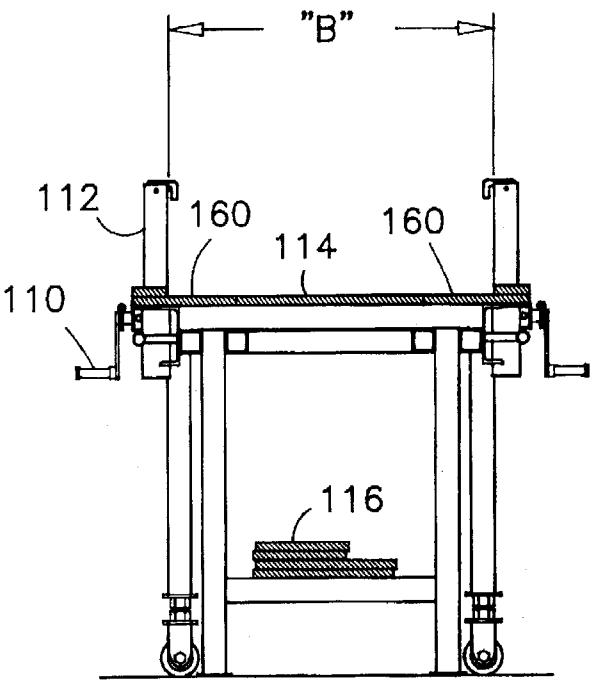
FIG. 24 is a cross section of the production table along line 24—24 of FIG. 14.

It is recommended that the production table of the preferred embodiment, the cross section of which is illustrated on FIGS. 24 and 25 be adjustable from a minimum width "B" of about 24" to a maximum width of "C" of about 60". Spacer boards 116 are placed between central board 114 and top plates 160 of side extensions 72 to obtain a constant spacing when tightening the latch mechanisms 120.

During the manufacturing of sign casings, the side members 42 or 44 are held in a vertical position by means of vertical holders 112. Each vertical holder 112 is telescopically mounted into a sleeve 162 through the shoulder 106.

Each vertical holder 112 has a hook 164 at its upper end which is dimensioned to fit loosely into the slot 50 of the side member 42 or 44. One vertical holder 112 per side of the production table 64 is sufficient to retain a side member 42 or 44 in a vertical alignment during the manufacturing of the casing. Several vertical holders 112 are provided for convenience to production workers.

Figure 27:
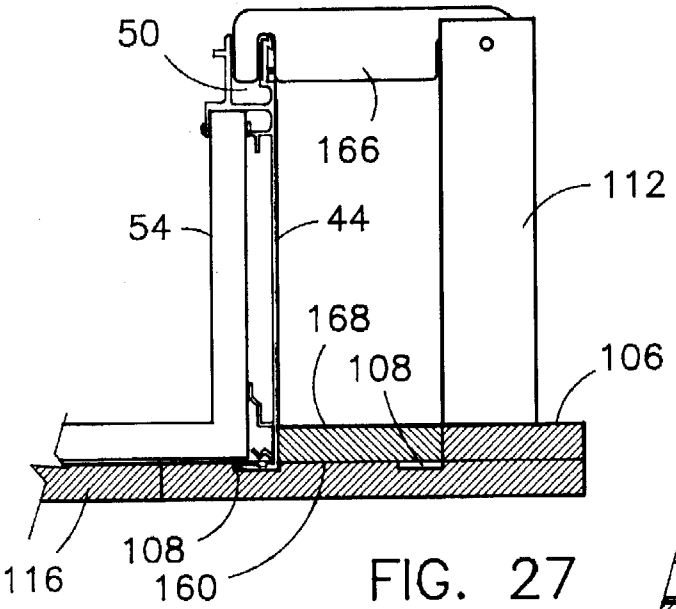
FIG. 27 illustrates a second model of a vertical holder for retaining a side member on a production table.

Whenever a manufacturer wants to manufacture sign casings having a width of less than the minimum width "B" of the production table 64, an extended hook 166 may be used in association with a spacer board 168 as shown on FIG. 27. In this event, it is recommended to have two grooves 108 on the surface 160 of the side extension 72. The two grooves 108 should be spaced apart a width of spacer board 168.

Figure 28:
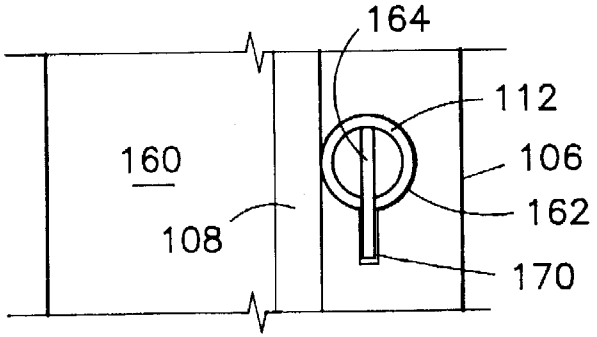
FIG. 28 is a top view of a vertical holder. The vertical holder is shown in a stowed down position with the holding tab inside a slot on the surface of the production table.

FIG. 28 illustrates a slot 170 through shoulder 106. Whenever a vertical holder 112 is not needed, or during the removal of a sign casing from the production table 64, the vertical holder 112 may be rotated 90° such that hook 164 may be lowered into slot 170. The vertical holder 112 stowed away in this manner causes no obstruction during the removal of a completed sign casing from the production table. Furthermore, such a design of a telescoping vertical holder 112 is very effective, easy to use and durable.

A latch mechanism 120 of the production table 64 of the present invention is illustrated in details on FIGS. 29 to 35. A latch mechanism 120 comprises a hollow rectangular tubing 170 with a threaded rod 172 therein, and a latch block 174 mounted on the threaded portion of the rod 172. The latch block 174 has a latch tab 176 protruding through an opening 178 in the lower wall of the tubing 172.

The threaded rod 172 of the latch mechanism 120 is longitudinally held within tubing 170 by means of a yoke 180. The crank handle 110 is mounted on one extremity of threaded rod 172, adjacent yoke 180.

Figure 26:
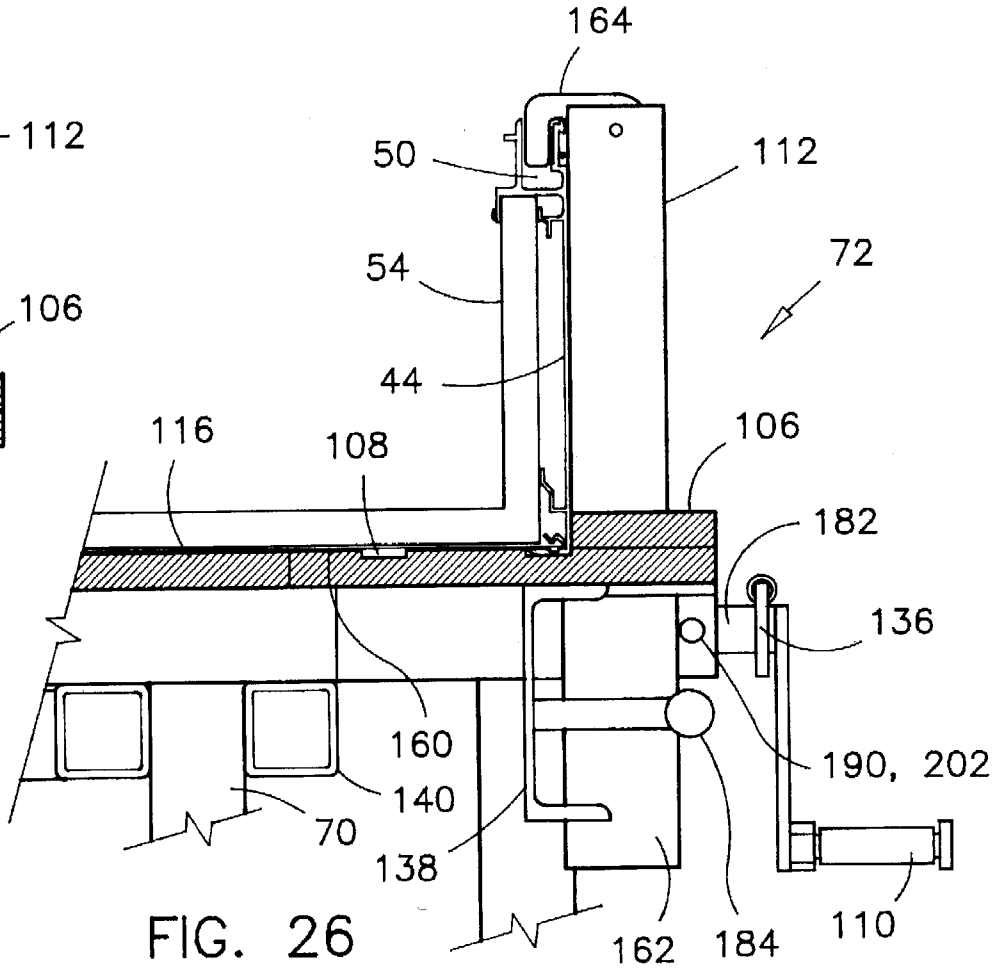
FIG. 26 illustrates a first model of a vertical holder for retaining a side member on a production table.

A transversal flat bar 136 is pivotally mounted on a shank portion 182 of crank handle 110 as it is better seen on FIG. 26. Flat bar 136 joins the shanks 182 of two crank handles 110 on one side extension 72, as one may see on FIGS. 13, 14 and 15.

The side extension 72 further has a handle bar 184 attached to channel 138 along a central portion of flat bar 136. When a force is applied onto flat bar 136 and handle bar 184 in opposing directions as shown by arrow 186 and 188 respectively, by manually squeezing the flat bar 136 and handle bar 188, the threaded rod 172 is pivoted upwardly about mounting bosses 190 of yoke 180. This movement of the threaded rod 172 causes the latch tab 176 to raise inside tubing 170 whereby adjustment of the side extension 72 relative to the main frame 70 may be effected.

Another method of adjusting the side extension 72 relative to the main frame 70 consists of threading block 174 outwardly until the inclined portion 192 of latch tab 176 climbs over a far edge of slot 178 and inside tubing 170. The latch mechanism 120 may then be slid freely inside guide channels 122.

When the latch block 174 is threaded towards crank handle 110, the latch tab 176 grabs onto one of the latch bar 144 of guide channel 122 on main frame 70, and pulls the side extension 72 towards the main frame 70. When both side extensions 72 are pulled towards the main frame 70, spacer boards 116 provide a stopper means to position shoulders 106 at a fixed distance from one-another to repeatedly manufacture sign casings of same dimensions.

The latch block 174 may also have a latch tab 194 with two vertical abutment surfaces, spaced apart a distance slightly less than a spacing between two adjacent latch bars 144. The latch tab 194 as shown on FIG. 33 enables both the extension and retraction of the side extension 72 upon a movement of crank handle 110 in a clockwise or a counter-clockwise direction respectively.

Figure 35:
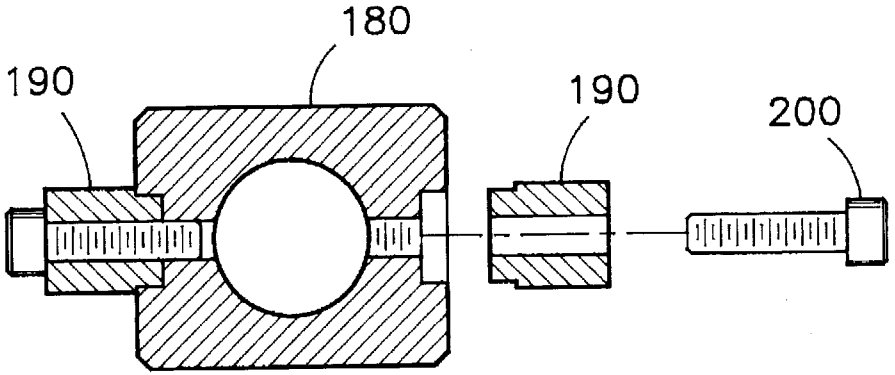
FIG. 35 is a cross section of the yoke on the threaded rod of the latch mechanism, along line 35—35 of FIG. 34.
Figure 34:
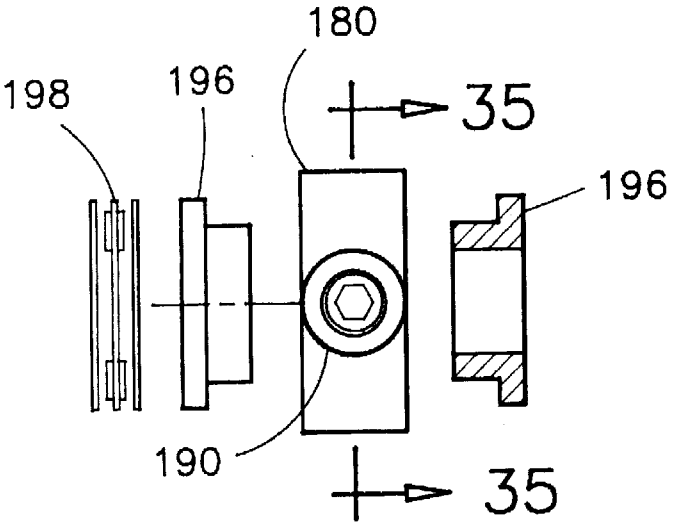
FIG. 34 is an exploded view of a yoke on the threaded rod of the latch mechanism.

The yoke 180 of the latch mechanism 120 is better illustrated on FIGS. 34 and 35. The yoke generally comprises two thrust washers 196, optional thrust bearings 198 adjacent each thrust washer 196, and two mounting bosses 190 which are retained to the yoke 180 by means of screws 200. The yoke 180 and thrust washers 196 are held on the threaded rod 172 by means of two cotter pins (not shown), snap rings (not shown) or other retainers of the like. The yoke is held inside tubing 170 through two holes 202 in tubing 170 one of which may be seen on FIG. 26. Each holes 202 is dimensioned to receive freely a respective mounting boss 190.

While the preferred embodiment of the invention has been described as a sign casing with two side members having each a deformable lip crimped into a backing sheet, those skilled in the art will appreciate that similar deformable lips may be used to retain other parts of a sign. Similarly, the apparatus described herein may also be used with or without modifications to manufacture rectangular casings other than sign casings.

Therefore, the preferred embodiment of the invention as described herein is not limited thereto, and it will be apparent to those skilled in the art that numerous modifications form part of the present invention insofar as they do not depart from the spirit, nature and scope of the described and claimed invention.

I claim:

1. A casing for sign having a front plane, a rear plane, a plurality of lengthy side members defining a contour thereof and a backing sheet adjoining said side members and covering said rear plane;

at least one of said side members has a first and second lips aligned longitudinally therealong and defining a slot enclosing an edge of said backing sheet;

said second lip having a longitudinal groove facing toward said first lip;

said first lip and said backing sheet being made respectively of a malleable material, and having each at least one common deformation bulging coincidently into said groove;

whereby said backing sheet is frictionally retained to said at least one side member relative to a transversal axis of said slot, between said deformation in said first lip and said groove in said second lip.

2. A casing for sign as claimed in claim 1 wherein said deformation is a plurality of spaced-apart spherical deformations.

3. A casing for sign as claimed in claim 2 wherein said backing sheet has a width of between about 24 inches to about 60 inches and said deformations in said plurality of spherical deformations are spaced apart a distance of between about 6 inches to about 10 inches.

4. A casing for sign as claimed in claim 1 wherein said deformation has the form of a conical percussion tool having a spherical end with a diameter of between about 0.080 inch to about 0.125 inch.

5. A casing for sign as claimed in claim 1 wherein said first lip has a region of reduced thickness adjacent a longitudinal connection of said first lip to said at least one of said side members, and wherein said deformation comprises a bend in said first lip in said region of reduced thickness.

6. A casing for sign as claimed in claim 1 wherein said first lip has a longitudinal V-shaped conformation facing away from said second lip, for receiving and stabilizing the tip of a pointed tool when said pointed tool is used for effecting said deformation.

7. A side member for installation on a periphery of a sign casing having spaced-apart front and rear planes and a backing sheet made of a first malleable material and covering said rear plane, said side member having:

a nominal length and width for enclosing a space between said front and rear planes on said periphery;

a first and second lips aligned longitudinally there along, and defining a slot for receiving and enclosing an edge of said backing sheet, said first lip being made of a second malleable material and said second lip having a longitudinal groove facing said first lip;

whereby when said backing sheet has an edge enclosed in said slot, and said first lip and said edge are deformed into a common coincident deformation bulging into said groove, said backing sheet is frictionally retained thereto relative to a transversal axis of said slot, between said deformation in said first lip and said groove in said second lip.

8. A side member as claimed in claim 7 further having a region of reduced thickness adjacent a longitudinal connection thereof to said first lip, for allowing said first lip to bend in said region of reduced thickness when said deformation is effected.

9. A side member as claimed in claim 7 wherein said first lip has a V-shaped conformation facing away from said second lip, for receiving and stabilizing the tip of a pointed tool when said pointed tool is used for effecting said deformation.

10. A method for manufacturing sign casing having a front plane, a rear plane, a plurality of lengthy side members enclosing a space around a periphery of said front and rear planes, and a backing sheet covering said rear plane; at least a pair of said side members having respectively a first and second lips aligned longitudinally there along and defining a longitudinal slot; said second lip having a groove facing said first lip and said backing sheet and said first lip being made respectively of a malleable material; said method comprising the steps of:

positioning said pair of said side members in a spaced-apart facing relationship;

placing opposing edges of said backing sheet into a respective said slots of said pair of said side members, effecting at least one coincident deformation in said first lip and in said backing sheet such that a swollen portion of said deformation bulges into said groove thereby frictionally retaining said backing sheet to one of said side member in said pair of said side members relative to a transversal axis of said slot between said deformation in said first lip and said groove in said second lip.

11. A method for manufacturing sign casing as claimed in claim 10 wherein said step of effecting at least one coincident deformation comprises the action of effecting a plurality of spaced-apart spherical deformations along said pair of said side members.

12. A method for manufacturing sign casing as claimed in claim 11 wherein said backing sheet has a width of between about 24 inches to about 60 inches and said deformations in said plurality of spherical deformations are effected at a distance of between about 6 inches to about 10 inches apart.

13. A method for manufacturing sign casing as claimed in claim 11 wherein said spherical deformations are effected by a conical hand-held percussion tool having a spherical end with a diameter of between about 0.080 inch to about 0.125 inch.

14. A method for manufacturing sign casing as claimed in claim 10 wherein said first lip has a V-shaped conformation facing away from said second lip, and said step of effecting at least one coincident deformation comprises the step of positioning the tip of a pointed tool in said V-shaped conformation and urging said tool toward said second lip.

15. A method for manufacturing sign casing as claimed in claim 14 wherein said pair of said side member have respectively a region of reduced thickness adjacent a longitudinal connection thereof to said first lip, and said step of effecting at least one coincident deformation comprises the action of bending said lip in said region of reduced thickness.

* * * * *